US008425089B2

(12) United States Patent
Venegas, Jr.

(10) Patent No.: US 8,425,089 B2
(45) Date of Patent: Apr. 23, 2013

(54) LIGHTED STANCHION COVER

(76) Inventor: Frank Venegas, Jr., Brighton, MI (US)

( * ) Notice: Subject to any disclaimer, the term of this patent is extended or adjusted under 35 U.S.C. 154(b) by 1568 days.

(21) Appl. No.: 09/829,033

(22) Filed: Apr. 9, 2001

(65) Prior Publication Data

US 2002/0145878 A1 Oct. 10, 2002

(51) Int. Cl.
*F21V 5/00* (2006.01)

(52) U.S. Cl.
USPC ..... 362/329; 362/431

(58) Field of Classification Search ..... 362/431, 362/268, 145, 152, 362, 248, 249, 240, 234, 362/186, 153, 153.1, 183, 223–225, 236, 362/238, 244, 249.01, 249.02, 249.04, 249.08, 362/249.12, 262, 310, 329, 351, 368, 800, 362/806, 812; 404/9, 5–7; 340/932.2
See application file for complete search history.

(56) References Cited

U.S. PATENT DOCUMENTS

| | | | | | |
|---|---|---|---|---|---|
| 2,260,082 | A | * | 10/1941 | McCauley | 40/564 |
| 3,080,149 | A | | 3/1963 | Pilboue | 256/57 |
| 3,181,849 | A | | 5/1965 | Mitchell | 267/1 |
| 3,416,484 | A | | 12/1968 | Chapman | 116/67 |
| 3,957,250 | A | | 5/1976 | Murphy | 256/19 |
| 4,019,301 | A | | 4/1977 | Fox | 52/725 |
| 4,281,369 | A | * | 7/1981 | Batte | 362/183 |
| 4,344,110 | A | * | 8/1982 | Ruediger | 362/560 |
| 4,438,484 | A | | 3/1984 | Winden | 362/267 |
| 4,454,671 | A | * | 6/1984 | Morgenstern | 40/606.12 |
| 4,479,319 | A | * | 10/1984 | Erlich | 40/595 |
| 4,486,820 | A | * | 12/1984 | Baba et al. | 362/183 |
| 4,718,185 | A | * | 1/1988 | Conlin et al. | 40/442 |
| 4,817,316 | A | * | 4/1989 | Walker | 40/576 |
| 4,819,135 | A | * | 4/1989 | Padilla et al. | 340/432 |
| 4,827,645 | A | * | 5/1989 | Stamps, Jr. | 40/567 |
| 4,924,362 | A | * | 5/1990 | Janko et al. | 362/108 |
| 5,105,347 | A | | 4/1992 | Ruud et al. | 362/268 |
| 5,121,307 | A | * | 6/1992 | Moore | 136/291 |
| 5,170,996 | A | | 12/1992 | Venegas, Jr. et al. | 256/69 |
| 5,323,583 | A | | 6/1994 | Venegas, Jr. | 52/727 |
| D349,164 | S | | 7/1994 | Fox | D25/38 |
| D374,941 | S | | 10/1996 | Venegas, Jr. | D25/126 |
| D380,274 | S | | 6/1997 | Stamets | D25/38 |
| 5,890,794 | A | * | 4/1999 | Abtahi et al. | 362/183 |
| 5,956,875 | A | * | 9/1999 | Aughenbaugh | 40/607.03 |

(Continued)

FOREIGN PATENT DOCUMENTS

| | | | |
|---|---|---|---|
| FR | 2260840 | A * | 10/1975 |
| GB | 2344915 | A * | 6/2000 |

(Continued)

*Primary Examiner* — Hargobind S Sawhney
(74) *Attorney, Agent, or Firm* — Gifford, Krass, Sprinkle, Anderson & Citkowski, P.C.

(57) ABSTRACT

A lighted stanchion cover for use with a stanchion for the purpose of providing illumination in dark conditions. The cover assembly comprising an elongated tubular body and a lighting assembly. The lighting assembly further comprising a light source and a power source. The elongated tubular body has an open end, a closed end, and an interior cavity. The interior cavity of the tubular body is dimensioned to receive a stanchion through its open end. A lighting assembly is disposed within the tubular body in a manner that does not interfere with the reception of the stanchion into the interior cavity of the tubular body. The lighted stanchion cover can be adapted to receive power from an integrated or external source. The tubular body can be customized to display messages or advertisements that can be easily seen in dark conditions.

2 Claims, 5 Drawing Sheets

U.S. PATENT DOCUMENTS

| | | | | | |
|---|---|---|---|---|---|
| 6,060,658 | A * | 5/2000 | Yoshida et al. | 136/243 | |
| D426,898 | S | 6/2000 | Venegas, Jr. | D25/126 | |
| 6,116,811 | A | 9/2000 | Goff | 404/6 | |
| 6,120,165 | A * | 9/2000 | Shalvi | 362/276 | |
| 6,158,881 | A * | 12/2000 | Carne | 362/183 | |
| 6,204,777 | B1 * | 3/2001 | Lyons | 340/908 | |

FOREIGN PATENT DOCUMENTS

| | | | |
|---|---|---|---|
| JP | 08239812 | A * | 9/1996 |
| JP | 08319609 | A * | 12/1996 |
| JP | 11316562 | A * | 11/1999 |

* cited by examiner

LIGHTED STANCHION COVER

FIELD OF THE INVENTION

The present invention generally relates to protective covers for stanchions, and more particularly to a protective cover with an integrated lighting assembly for the purpose of providing illumination around the stanchion in darkness or other low visibility conditions.

BACKGROUND OF INVENTION

Stanchions are primarily used as protective barriers for guarding stationary structures against damage that would result from being struck by a vehicle. They are commonly found in industrial facilities, parking garages and lots, and around drive thru lanes at restaurants. Generally, stanchions consist of an outer sleeve of elongated tubular steel and a concrete core. In construction, one end and a portion of the elongated tubular steel body is supported perpendicularly in a fixed surface while the opposite end extends above the fixed surface at a distance approximately equal to the embedded portion. The interior cavity of the elongated tubular steel member is commonly filled with concrete as a reinforcing complement. While stanchions can adequately protect stationary structures against damage from vehicle accidents, it is not uncommon for people to receive minor injuries, or their vehicles to receive minor damage, when contact is made with a stanchion.

Protective covers, as described in U.S. Pat. No. 5,323,583, aid in reducing injury to people, and damage to cars, that make contact with unprotected stanchions. The smooth surface of protective covers minimizes the scratching or cutting that occurs when a grazing contact is made with an unprotected stanchion that typically have a rough surface. Additionally, by covering a stanchion with a resilient protective cover, repetitive maintenance that stems from long-term exposure is minimized and its esthetic appearance is enhanced.

For various applications, protective covers are made in several different sizes and colors. Such covers may also be customized to display a customer logo or advertisement. The lightweight structure and design of such covers allows for quick and easy installation. Once fitted to a stanchion, the protective cover enhances its esthetic features while providing a durable and smooth surface that reduces repetitive maintenance and injury that may occur from minor accidents. Colored covers have good visibility, but in dimly light to dark conditions the cover's visibility is substantially decreased.

Lighting bollards, such as the one described in U.S. Pat. No. 4,438,484, are low-level ground mounted lighting structures primarily in use in urban environments for lighting pedestrian walkways and building entrances at night. Lighting bollards typically feature a base, a steel housing fashioned with one or more windows, and a source of illumination. The source of illumination, and its supporting electrical components, are generally mounted within the interior of the housing and receives its power from an external source. Other types of low-level outdoor lighting elements are used in residential landscaping applications to provide illumination around patios, walkways, or plant beds. These lighting elements commonly feature electrical conductors and a lamp receptacle disposed within an esthetic plastic housing. To provide power to these elements, they are generally connected to a track lighting type of network below the earth's surface.

While both these lighting structures are intended to provide illumination, neither is intended for use as a protective cover for a stanchion while providing light. A protective cover is useful for reducing repetitive maintenance and enhancing the esthetic character of stanchions, but a lighted protective cover would provide the additional feature of high visibility in a dark environment. Lighting bollards can provide the necessary light to maintain high visibility in poorly illuminated areas but they cannot provide the protective function of a stanchion.

SUMMARY OF THE INVENTION

The present invention is directed toward providing a lighted stanchion cover for a stanchion that includes an elongated tubular body with a lighting assembly disposed within its exterior surface. In the preferred embodiment, the lighted stanchion cover provides the stanchion with illumination without sacrificing the protective barrier function of the stanchion.

A preferred embodiment of the lighted stanchion cover, according to the invention, includes an elongated tubular body with opposite ends, one end open and the other closed. The interior cavity of the cover is dimensioned to receive the entire stanchion through its open end in slip fit engagement. A lighting assembly, that includes a light and power source, is integrated within the body of the cover and is fashioned so not to interfere with reception of the stanchion into the cover.

In the preferred embodiment, the lighting assembly is designed to receive power from an external power source. A second embodiment has the lighting assembly designed to receive power from an internal power source.

Optionally, to improve power efficiency, an electronic circuit can be integrated into the lighting assembly for power management and control to ensure that electrical energy will only be expended under certain conditions as a method of energy conservation.

Preferably, a lighted cover will be fastened to the fixed surface by use of a conventional fastening means sufficient for such purpose.

DETAILED DESCRIPTION OF THE INVENTION

Figure 1A:
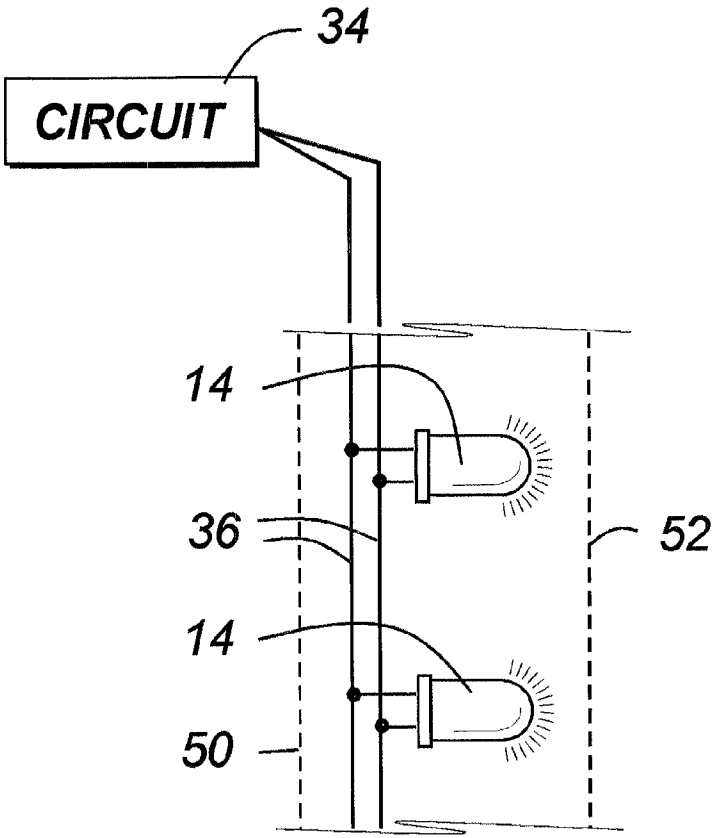
FIG. 1*a* is an enlarged view of an integrated light source according to the invention.
Figure 1:
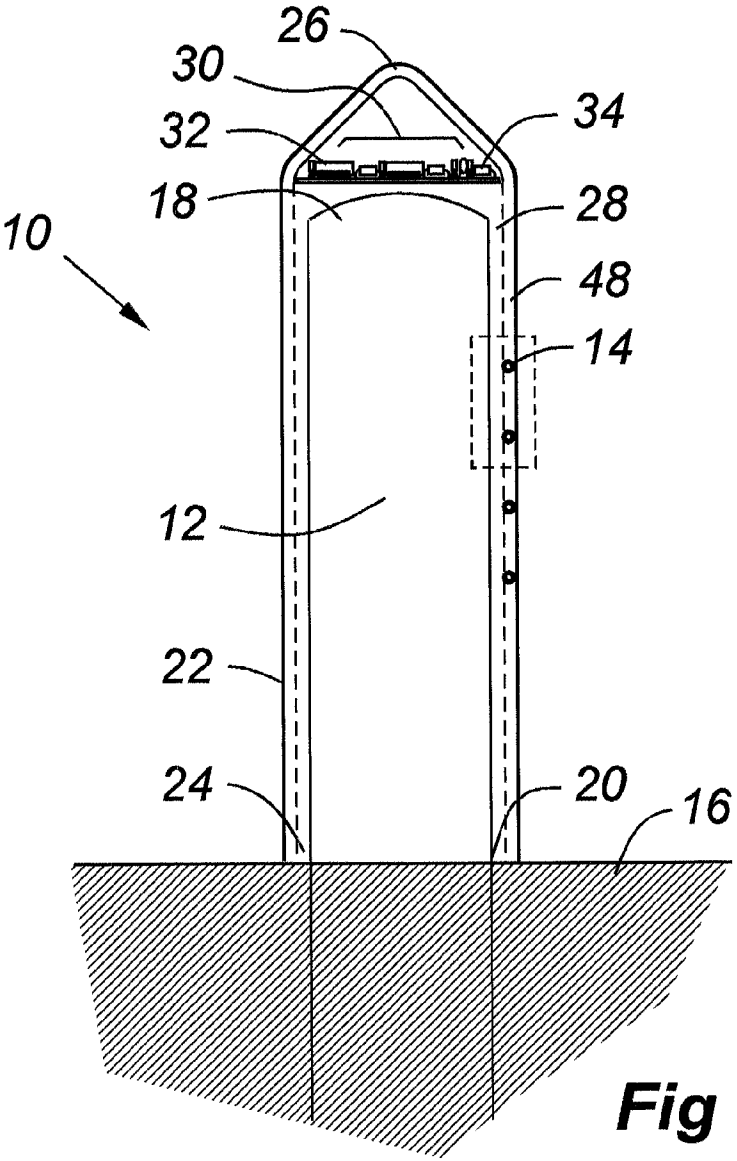
FIG. 1 is a side elevational view of a lighted stanchion cover according to the invention.

The lighted stanchion cover for a stanchion according to the invention is generally shown in the figures and indicated by reference number 10. With reference to FIG. 1, a preferred embodiment of a lighted stanchion cover 10 for stanchions includes an elongated tubular body 22, a lighting assembly 30, and may include a stanchion 12 where a pre-existing stanchion is absent.

Figure 4:
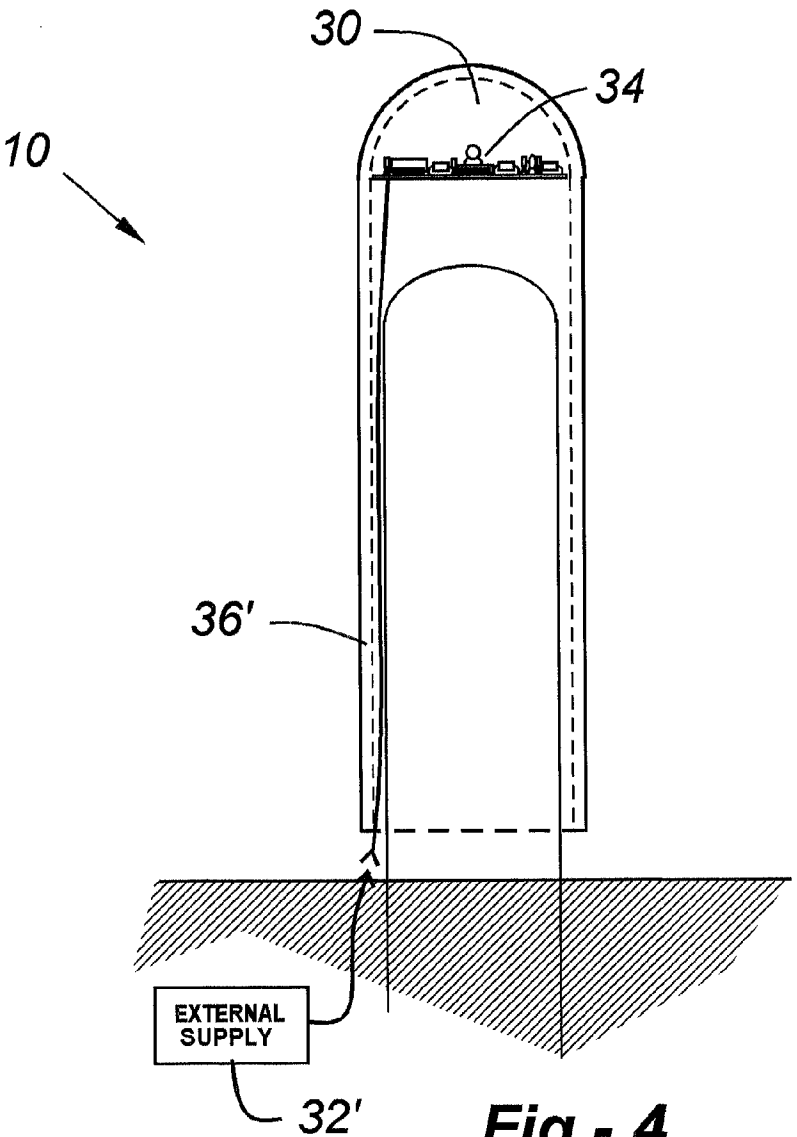
FIG. 4 is side elevational view of a stanchion being received into the interior cavity of the tubular body.

In construction, the stanchion extends outwardly from a fixed surface 16 and has a cap 18 and a base 20. Accordingly, the elongated tubular body 22 of the lighted cover 10 extends linearly between an open end 24 and a closed end 26. With reference to FIG. 4, the elongated tubular body 22 is dimensioned to receive the stanchion 12 through its open end 24 into its interior cavity 28 unimpeded by the lighting assembly 30, which includes a power source 32 and a light source 14 (See FIG. 1).

Figure 3:
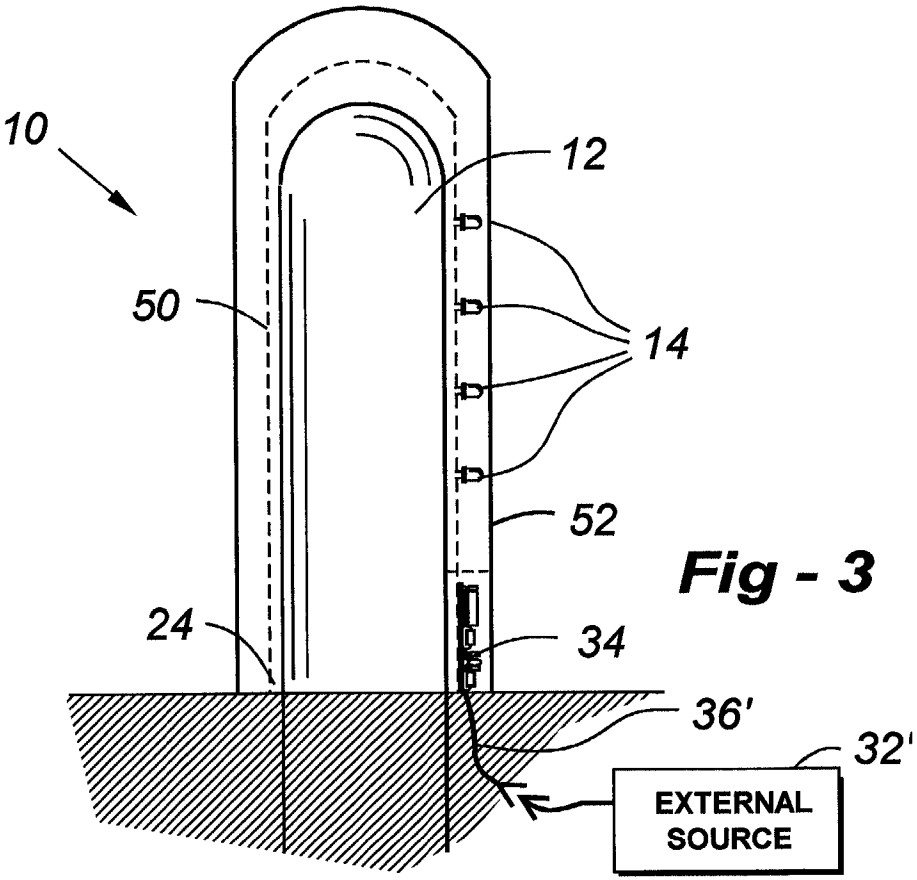
FIG. 3 is a side elevational view of the lighted stanchion cover using an external power supply.
Figure 7A:
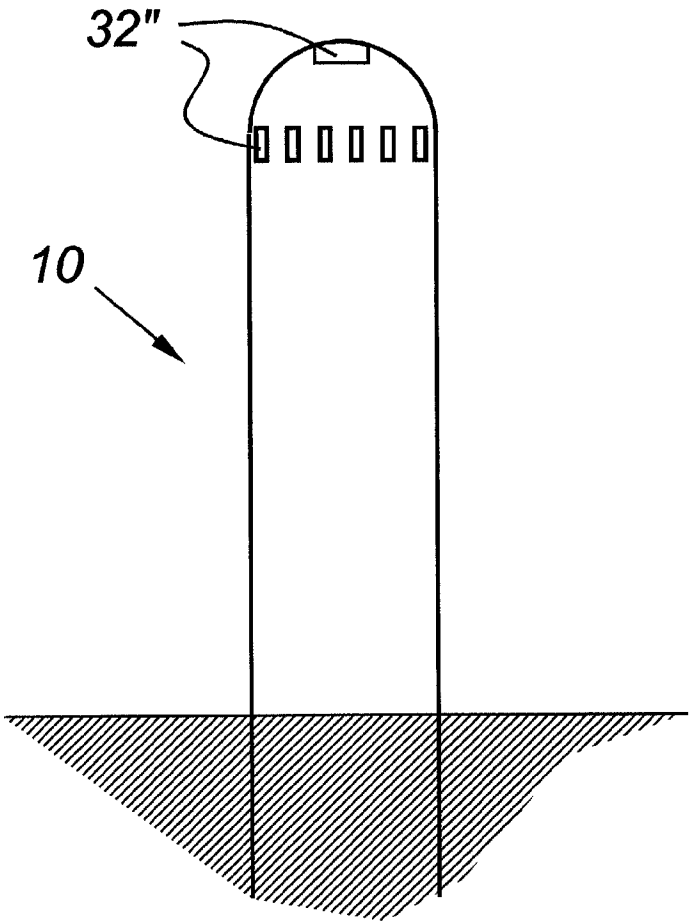
FIGS. 7 and 7*a* are side elevational views of the lighted cover using photovoltaic devices as the power source.
Figure 7:
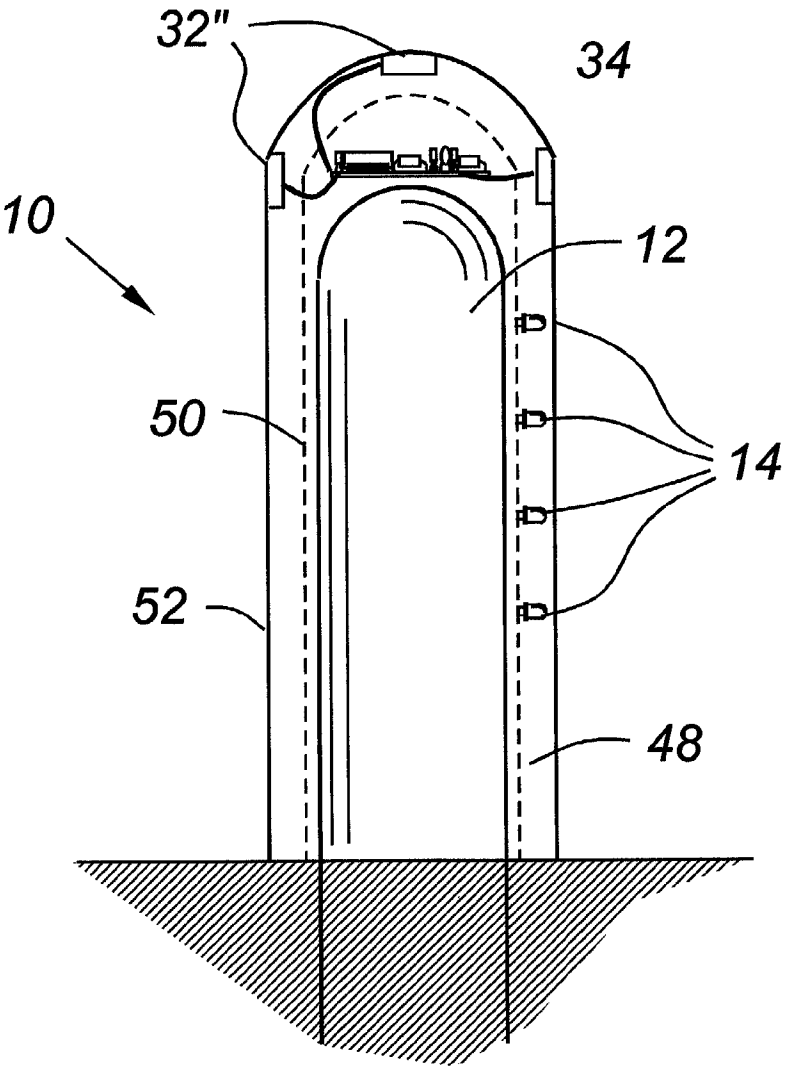

In the preferred embodiment, the power source 32 would require minimal maintenance such as an external power source 32' (refer to FIG. 3). Alternatively, referring to FIG. 1 and 7 respectively, other power sources can be used such as a battery 32 or photovoltaic devices 32". Further, referring to FIG. 1, the preferred embodiment integrates the light source 14 within the elongated tubular body 22. In this case, the light source being used is a plurality of light emitting diodes 14 connected to the electronic circuit 34 through electrical conductors 36 (refer to FIG. 1*a*). The light emitting diodes 14 can be positioned within the thickness 48 of the elongated tubular body 22 so as to display a lighted message.

Figure 5:
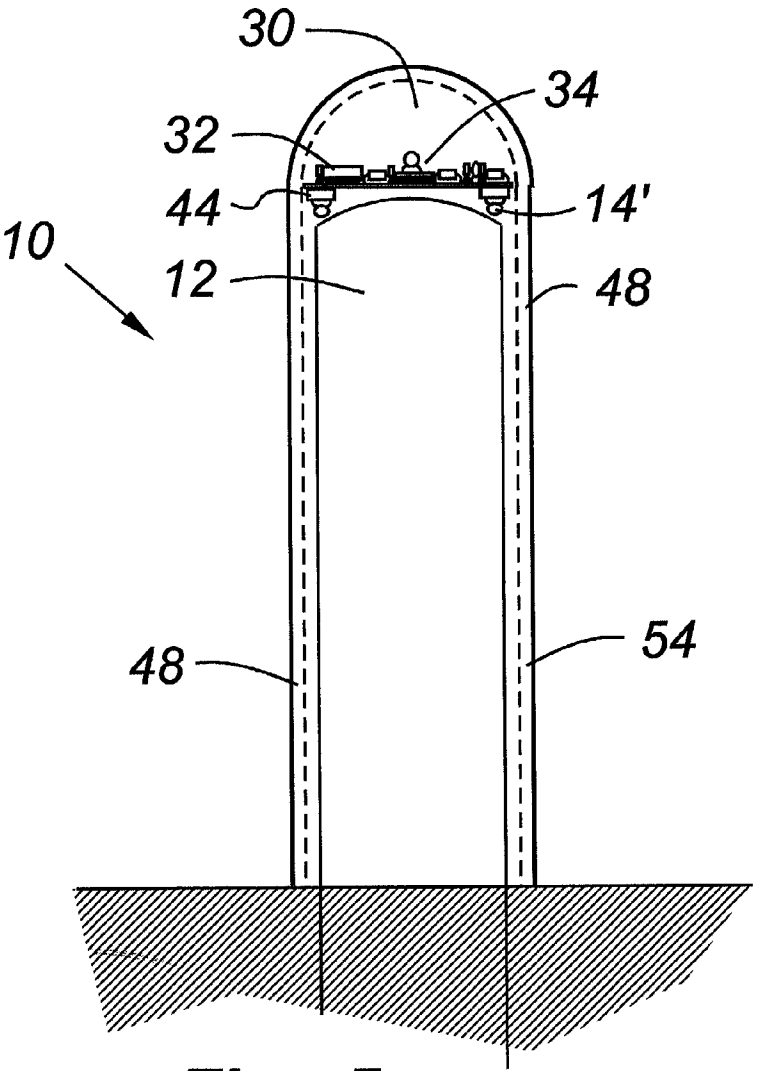
FIG. 5 is a side elevational view of a lighted stanchion cover having light sources within a second cavity of the elongated tubular body.

The lighted cover may use other light sources such as halogen, incandescent, or florescent lamps 14' that can be disposed in a lamp receptacle 42 within the interior cavity 24 of the elongated tubular body 22. FIG. 5 shows an embodiment that supports a translucent partition 44 below the lighting assembly 30 and above the cap 18 of the stanchion to facilitate lighting the cover from the cap 18 of the stanchion to the base 20.

The lighting assembly 30 may include an electronic circuit 34 used for power management and control. Preferably, the electronic circuit 34 would include light and/or vibration sensing elements to trigger illumination only under dark conditions and when a vehicle is in close proximity to the stanchion.

In the preferred embodiment, the power source 32', is near the base 20 of the stanchion 12, and is in communication with the electronic circuit 34 of the lighting assembly 30 that is positioned above the cap 18 of the stanchion and within the closed end 26 of the elongated tubular body 22. Further, the electronic circuit 34 is in communication with the light emitting diodes 14 positioned within the thickness 48 of the elongated tubular body 22.

Figure 2:
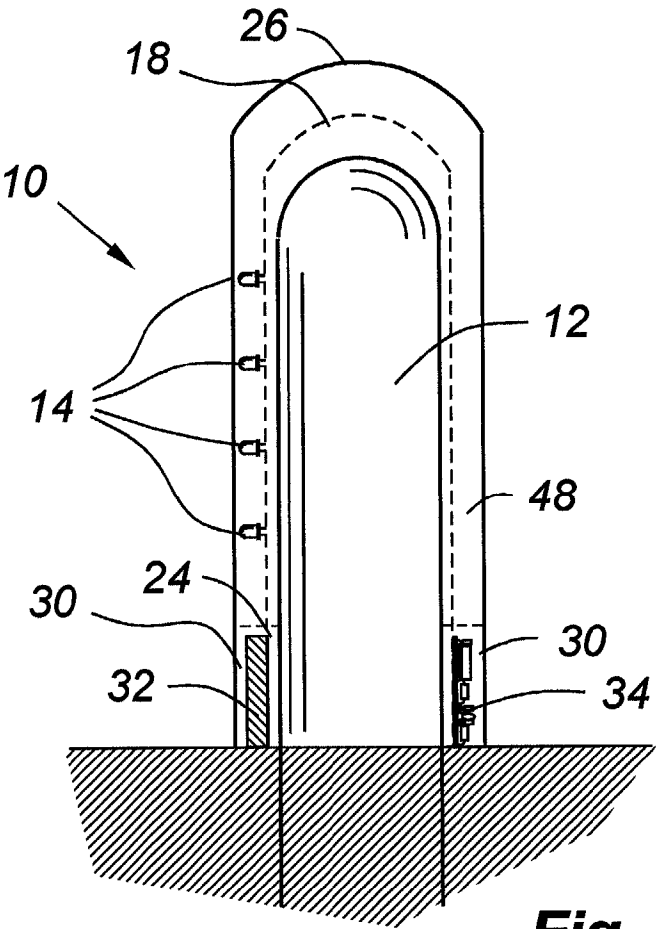
FIG. 2 is a side elevational view of the lighted stanchion cover with the lighting assembly shown at the base of the tubular body.
Figure 6:
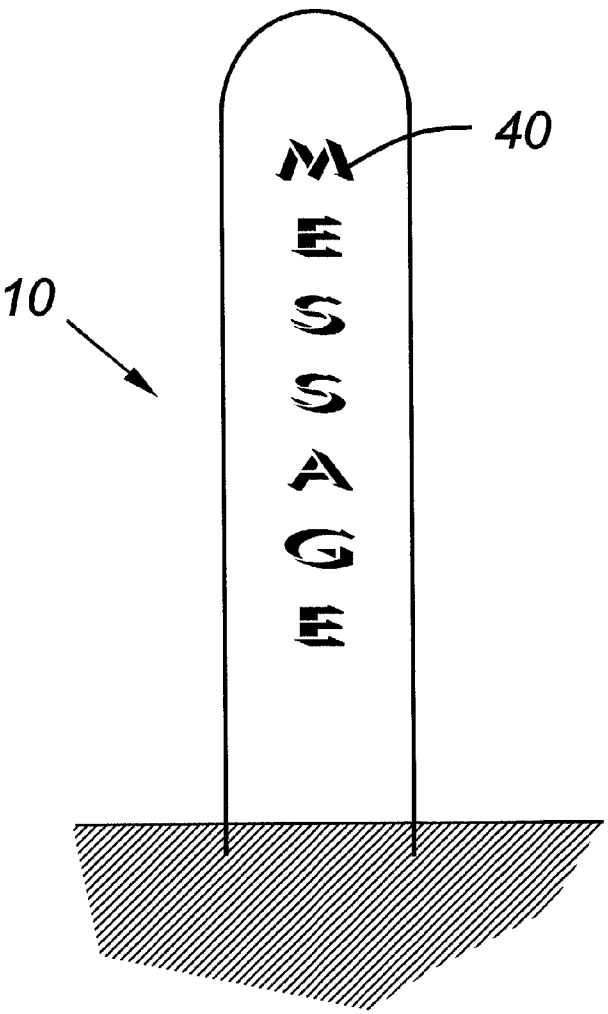
FIG. 6 is a side elevational view of a lighted stanchion cover with a stenciled message upon the elongated tubular body.

Another embodiment, referring to FIG. 2, can have the power source 32 and the electronic circuit 34 disposed within a second cavity 48 of the elongated tubular body 22 near its open end 24 while the light emitting diodes 14 are also disposed within the thickness 48 of the elongated tubular body 22. The elongated tubular body 22 can be customized to display a message, such as an image or stenciled letters 40 (See FIG. 6).

Figure 8:
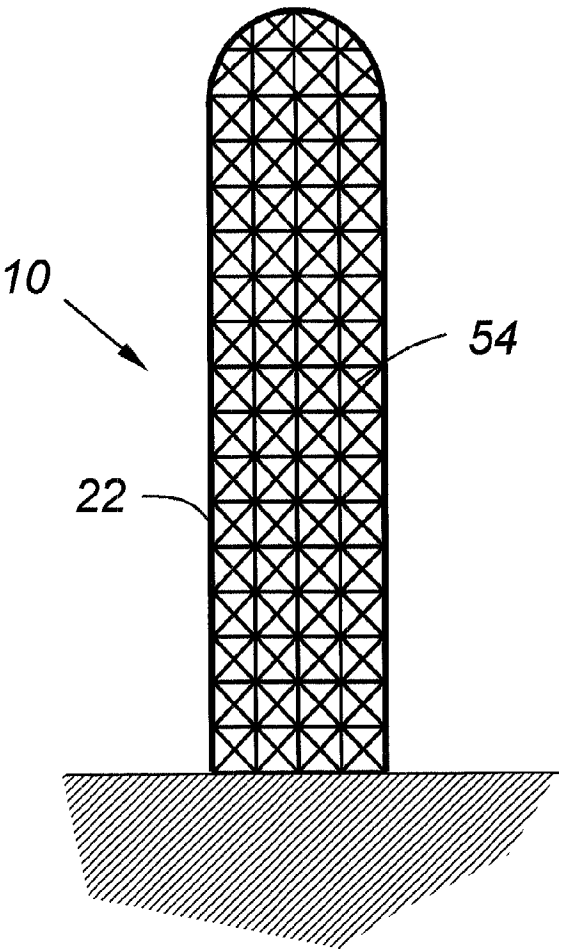
FIG. 8 is a side elevational view of a lighted stanchion cover designed so that the elongated tubular body has one or more light dispersing windows.

Alternatively, as shown in FIG. 8, the elongated tubular body 22 can be designed so that the body has one or more light dispersing windows 54. Still further, a second cavity, defined as a space between the inner and outer surface of the elongated tubular body 22, may be used to encapsulate a photoluminescent mixture as an indirect source of illumination (not shown).

The elongated tubular body 22 of the lighted cover 10 may be formed of a number of suitable, malleable structural materials, and is preferably formed of a structural plastic, including, for example, generally available low density polyethylenes and LEXAN™ brand polycarbonate. Also as known in the molding of plastics, various coloring agents may be mixed into the material of which the elongated tubular body 22 is formed to provide a durable coloring throughout. Further, a variety of material enhancing additives may be used, including, but not limited to, additives to resist ultraviolet deterioration.

The above and other features and uses of the invention will be recognized by those skilled in the art, from the specification, the claims that follow, and the attached drawings.

The embodiments for which an exclusive privilege is claimed are defined as follows:

1. A lighted assembly for use with a stanchion extending outwardly from a ground surface comprising:

an elongated tubular body having an open end, and a closed end defining an interior cavity, the open end and the interior cavity of the elongated tubular body being dimensioned to receive the stanchion substantially entirely therein such that the open end is proximate to or in contact with the ground surface;

a source of electrical power disposed inside or outside of the elongated tubular body; and a lighting assembly having a light source interconnected to a power source, the light assembly being secured relative to the tubular body so that the light is visible exteriorly of the interior cavity; and further including a proximity detector and control electronics operative to activate the light source when a vehicle is in close proximity to the stanchion.

2. A lighted stanchion cover for use with a stanchion extending outwardly from a fixed surface comprising:

an elongated tubular body having an open end, and a closed end, and defining an interior cavity, the open end and the interior cavity of the body being dimensioned to receive the stanchion therein, and the body having an inner and outer surface defining a thickness, the inner and outer surfaces and the thickness defining a second cavity, the second cavity being adapted to encapsulate a photoluminescent mixture; and a lighting assembly, having a light source interconnected to a power source, the light assembly being supported within the interior cavity of the elongated tubular body, and the lighting assembly not interfering with the elongated tubular body receiving the stanchion.

* * * * *